US006941898B2

(12) United States Patent
Smith et al.

(10) Patent No.: US 6,941,898 B2
(45) Date of Patent: Sep. 13, 2005

(54) COMBINED LIQUID FOAM STOP AND INSULATOR FOR A TANK ASSEMBLY

(75) Inventors: Bonnie C. Smith, Church Hill, TN (US); Steve D. Ross, Gray, TN (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 10/453,730

(22) Filed: Jun. 3, 2003

(65) Prior Publication Data

US 2004/0244728 A1 Dec. 9, 2004

(51) Int. Cl.[7] ..... B65D 25/34; F22B 5/04
(52) U.S. Cl. ..... 122/19.2; 220/694.1
(58) Field of Search ..... 122/19.2, 494; 220/567.3, 495.01, 694.1

(56) References Cited

U.S. PATENT DOCUMENTS 4,372,028 A 2/1983 Clark et al.
4,860,728 A 8/1989 Nelson
4,901,676 A 2/1990 Nelson
4,911,142 A * 3/1990 Nelson ..... 122/19.2
4,945,892 A 8/1990 Chevalier et al.
4,957,097 A 9/1990 Chevalier et al.
4,972,967 A 11/1990 Nelson
5,024,210 A 6/1991 Nelson
5,052,347 A 10/1991 Nelson
5,163,214 A 11/1992 Calero
5,209,368 A 5/1993 Bradenbaugh
5,213,728 A * 5/1993 Hickman ..... 264/46.9
5,263,469 A 11/1993 Hickman
5,299,280 A 3/1994 Ruark
5,460,290 A 10/1995 Hanning et al.
5,509,566 A 4/1996 Nelson

* cited by examiner

*Primary Examiner*—Gregory Wilson
(74) *Attorney, Agent, or Firm*—Inger H. Eckert; Maria C. Gasaway

(57) ABSTRACT

The present invention relates to a combined liquid foam stop and insulator for a tank assembly including a fibrous material strip and a nonflammable insulating skirt connected to the fibrous material strip. In an alternative embodiment the invention is the liquid foam stop in the form of a fibrous material strip and in the absence of the nonflammable insulating skirt. Further, the invention includes a gas water heater incorporating the liquid foam stop or the combined liquid foam stop and insulator of the present invention.

19 Claims, 3 Drawing Sheets

COMBINED LIQUID FOAM STOP AND INSULATOR FOR A TANK ASSEMBLY

TECHNICAL FIELD AND INDUSTRIAL APPLICABILITY OF THE INVENTION

The present invention relates generally to thermally insulated tank assemblies and, more particularly, to an improved liquid foam stop and insulator for a tank assembly as well as a water heater incorporating such a liquid foam stop.

BACKGROUND OF THE INVENTION

Insulated tank assemblies such as water heaters have long been known in the art. Such structures typically comprise an inner storage tank or vessel and an outer shell or jacket. Typically, both the inner storage tank and outer jacket are cylindrical in shape. Typically the jacket is coaxial with and radially spaced from the tank so that an annular space or void is formed there between. A polymer foam insulating material is commonly provided in at least a portion of this annular space to provide thermal insulation for the liquid held in the storage tank.

A particularly effective insulating material for this purpose is a polymer foam that is expanded directly in the annular space between the inner tank and jacket. Various types of epoxy and polyolefin foams have been utilized for this purpose and polyurethane foam has been found to be particularly effective.

As is known to those skilled in the art, a polymer reactive composition is injected into the void or space between the tank and jacket and the resulting foam expands to fill the available space. The polymer foam is initially fluid and sticky. It, however, slowly expands to fill substantially all the space between the tank and jacket. As the polymerization reaction reaches its completion the polymer foam becomes stiff and stabilizes into a rigid, closed cell foam that fills the annular space surrounding the tank and forms a thermal insulation for the liquid held in the tank. The amount of liquid polymer reactant composition injected into the annular space is only sufficient to ensure that the annular space is filled with polymer foam without creating excessive over-pressure in the space.

Water heater tanks incorporate a number of inlet, outlet and drain fittings. A gas water heater includes a heating chamber at the bottom of the tank. Specifically, a gas burner is positioned in the heating chamber and water in the tank is heated with a flame from the burner. The tank also includes sensors for thermostatic control so that the water in the tank is maintained at a desired temperature.

Many polymer foams used for insulation purposes are flammable and, accordingly, they must be maintained a safe distance from the open burner flame of the heating chamber.

It is presently common practice to provide a foam dam device in place in the annular space between the inner tank and outer jacket at a selected position along the height of the cylindrical inner tank. More specifically, the foam dam is compressed between the outer wall of the inner tank and the inner wall of the outer jacket so as to seal the space therebetween. Accordingly, the inner tank, the foam dam and the upper wall and side wall of the outer jacket form a sealed space that may be filled with the insulating polymer foam. The compressive sealing engagement of the dam between the tank and the jacket prevents the polymer foam from entering the lower portion of the annular space which includes the heating chamber and burner. U.S. Pat. No. 5,209,368 to Bradenbaugh is exemplary of this type of arrangement.

In the Bradenbaugh patent, the foam dam is a ring of polyurethane material that rolls down along the side of the inner tank as the jacket is positioned over the inner tank. In other prior art approaches, a slip agent such as talc is applied to the internal tank and the ring-shaped dam slips down along the internal tank as the jacket is placed over the tank.

The present invention relates to a liquid foam stop or dam for a tank assembly made from advanced materials that provide enhanced performance. Further, the liquid foam stop is wrapped around the inner tank at its desired position before positioning the jacket over the inner tank to thereby better ensure its proper positioning in the final product.

SUMMARY OF THE INVENTION

In accordance with the purposes of the present invention as described herein, an improved combined liquid foam stop and insulator is provided for a tank assembly. The combined stop and insulator comprises a fibrous material strip and a nonflammable insulating skirt connected to the fibrous material strip.

The fibrous material strip may be made from a material selected from a group consisting of polyester, polyethylene, polypropylene, polyethylene terephthalate, glass fibers and any mixture thereof. The nonflammable insulating skirt may be made from fiberglass. The fibrous material strip has a first thickness $T_1$ and the nonflammable insulating skirt has a second thickness $T_2$ where $T_1>T_2$. The thickness $T_1$ may be from about 2.52 to about 5.04 cm and the thickness $T_2$ may be from about 1.26 to about 2.52 cm.

An adhesive may be provided for securing the fibrous material strip with the nonflammable insulating skirt. Further, the fibrous material strip may have a density of between about 1.5 to about 4.5 kg/m$^3$. The strip also has a first face, a second face, a first side, a second side, a first end and a second end. Thus, the strip takes the form of a sheet that may be wrapped around the tank to be insulated.

In accordance with yet another aspect of the present invention a liquid foam stop may be provided for a tank assembly. The stop comprises a fibrous material strip made from a material selected from a group consisting of polyester, polyethylene, polypropylene, polyethylene terephthalate, glass fibers, natural fibers and any mixtures thereof. The fibrous material strip includes first and second ends and may be wrapped around a tank at any desired position. Preferably, the strip is of a length sufficient to extend around the circumference of the tank so that the two ends just meet in abutting relationship when wrapped tightly around the tank.

An interlocking structure is provided to allow the ends of the strip to be positively connected together. Alternatively, the interlocking structure allows two or more strips to be interconnected in series. More specifically, a projecting lug is provided on a first end of the strip and a cooperating lug receiving socket is provided on a second end of the strip.

In accordance with yet another aspect of the present invention, a water heater is provided. That water heater includes an inner tank including a water inlet and a water outlet. An outer jacket is received around the inner tank. The inner tank and outer jacket form a void therebetween. In addition a heating chamber is provided adjacent the inner tank.

Still further, the water heater also includes a liquid foam stop made from a fibrous strip of material selected from a group consisting of polyester, polyethylene, polypropylene, polyethylene terephthalate, glass fibers, natural fibers and any mixtures thereof. The liquid foam stop seals against the inner tank and the outer jacket so as to divide the void into a first section remote from the heating chamber and a second section adjacent the heating chamber. The first section of the void holds a polymer foam insulating material and the second section holds a nonflammable insulating material.

In accordance with another embodiment of the present invention, the liquid foam stop further includes a nonflammable insulating skirt. In this embodiment the first section of the void holds a polymer foam insulating material while the insulating skirt insulates the second section of the void.

In the following description there is shown and described preferred embodiments of this invention, simply by way of illustration of several of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of this specification, illustrate several aspects of the present invention, and together with the description serve to explain certain principles of the invention. In the drawings.

Reference will now be made in detail to the present preferred embodiments of the present invention, examples of which are illustrated in the accompanying drawings.

DETAILED DESCRIPTION OF THE INVENTION

Figure 1:
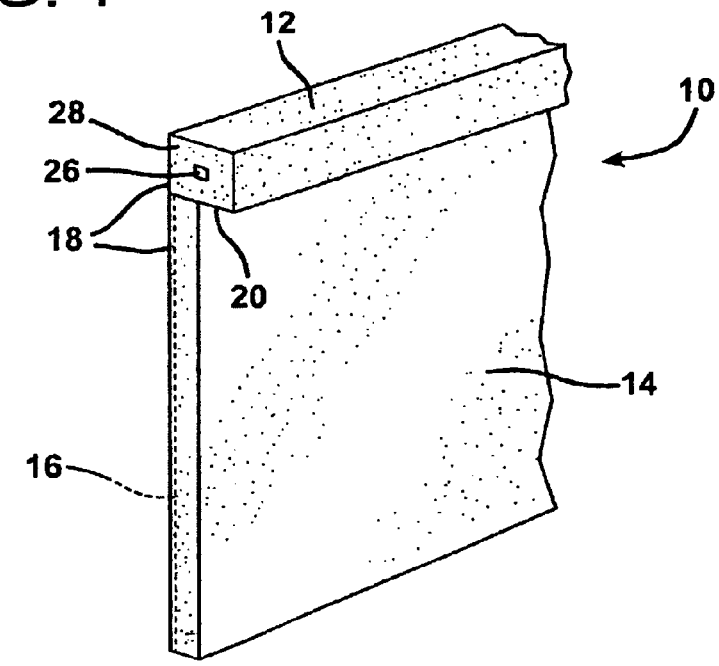
FIG. 1 is a perspective view of a combined liquid foam stop and insulator for a tank assembly constructed in accordance with the teachings of the present invention.
Figure 2:
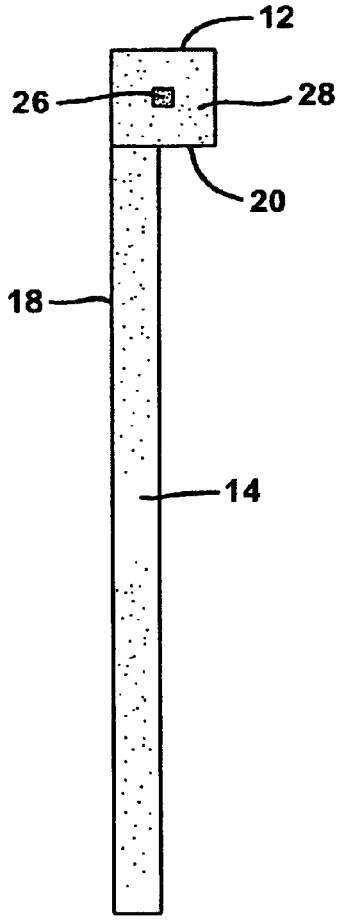
FIG. 2 is an end view of the invention shown in FIG. 1.

Reference is now made to FIGS. 1 and 2 showing a first embodiment of the combined liquid foam stop and insulator 10 of the present invention. As should be appreciated such an insulator 10 is particularly useful to insulate water tank assemblies such as the hot water heater illustrated in FIG. 5.

The combined liquid foam stop and insulator 10 comprises a fibrous material strip 12 and a nonflammable insulating skirt 14 connected to the fibrous material strip. The fibrous material strip 12 may take the form of (a) thermoplastic polymer staple fibers and thermoplastic bicomponent fibers, (b) glass staple fibers and thermoplastic bicomponent fibers, and (c) a combination of (a) and (b). The thermoplastic staple fibers and bicomponent fibers may be selected from a group of materials including but not limited to polyester, polyethylene, polypropylene, polyethylene terephthalate and any mixtures thereof. The glass fibers may include E-glass, S-glass or basalt fibers. Natural fibers such as hemp and kenaf may also be included. As a specific example, the fibrous material strip 12 may be die cut from blended polyester material such as VersaMat 800 WH material as manufactured by Owens Corning OEM Solutions Group of Louisville, Ky.

The fibrous material strip 12 may have a density of between substantially 1.5 to substantially 4.5 kg/m$^3$. It may also include an integral skin or surface layer 16 of still higher density in order to provide some additional rigidity to allow easier handling during installation and also provide a smooth face particularly suited for sealing against the inner tank of, for example, a water heater. Of course, such a skin or surface layer may be provided on the other face as well to seal against the inner wall of the outer jacket. In any embodiment, the strip 12 must have sufficient structural stiffness to resist foam penetration during the foaming process as described in greater detail below.

The nonflammable insulating skirt 14 may be made from fiberglass. Such material provides not only insulation but is also heat and flame resistant. Accordingly, the skirt 14 is particularly suited for insulating the inner tank of a water heater in and around the area of the heating chamber and burner as will be described with reference to FIG. 5 in greater detail below.

As best illustrated in FIG. 2 the fibrous material strip 12 has a first thickness $T_1$ and the nonflammable insulating skirt 14 has a second thickness $T_2$ where $T_1>T_2$. Typically the thickness $T_1$ of the strip 12 is about 2.52 to about 5.04 cm and the thickness $T_2$ of the skirt 14 is about 1.26 to about 2.52 cm. As illustrated, the strip 12 is connected to the skirt 14 so as to provide one continuous sidewall 18 and an outcropping shelf 20. The strip 12 and skirt 14 may be molded integrally together as one piece or, in the alternative, they may be adhered together using an appropriate adhesive. Such an adhesive includes, for example, solvent based contact glue, high temperature glue or water based spray adhesive.

Figure 3:
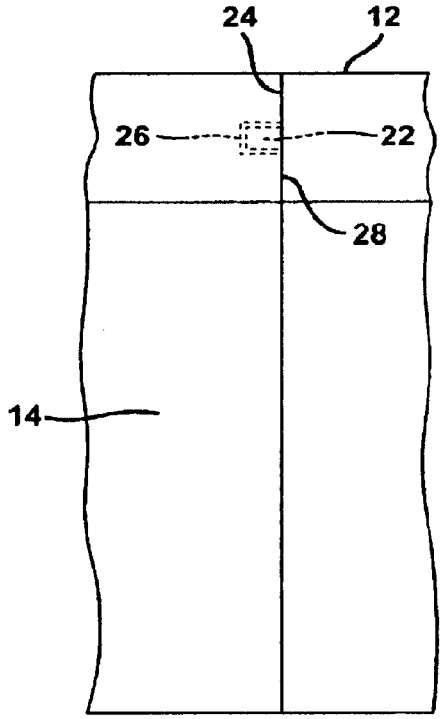
FIG. 3 is a detail elevational view showing the first and second ends of the liquid foam stop of FIG. 2 interconnected together.

As further illustrated in FIGS. 1–3, each strip 12 may include an interlocking structure so that the strip may be formed into a ring with the two abutting ends of the strip positively locked together. More specifically, the strip 12 includes a projecting lug 22 at a first end 24 and a cooperating aperture or socket 26 sized and shaped to receive the lug, on a second, opposite end 28. As should be appreciated from viewing FIG. 3, the lug 22 is fully received and fits snugly in the aperture or socket 26 allowing the ends 24, 28 of the strip to abut one another when the ends are joined to form the strip 12 into a ring. Of course, it should also be appreciated that the interlocking structure (i.e. the lug 22 and aperture/socket 26) also allows multiple strips 12 to be joined together end to end so as to provide a combined liquid foam stop and insulator 10 of substantially any desired length.

Figure 4:
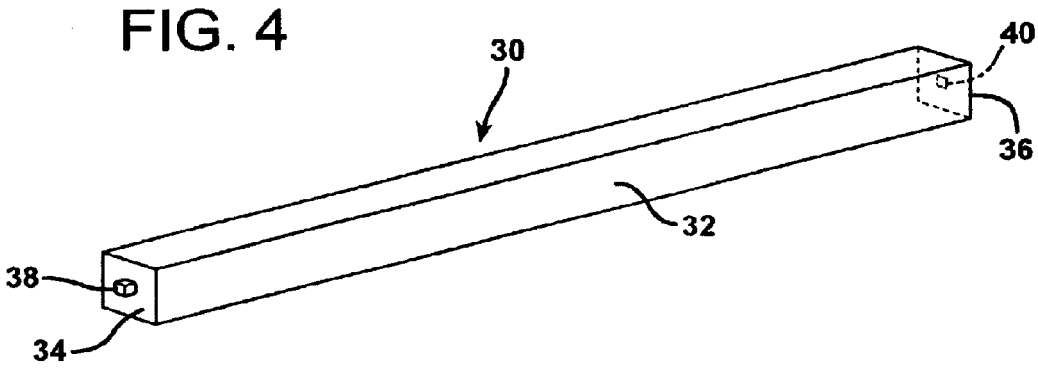
FIG. 4 is a perspective view of a second embodiment of the present invention comprising a liquid foam stop for a tank assembly.

An alternative embodiment 30 of the present invention is illustrated in FIG. 4. The alternative embodiment 30 comprises a liquid foam stop in the form of a fibrous material strip 32. That strip 32 is made from a material selected from a group consisting of polyester, polyethylene, polypropylene, polyethylene terephthalate, glass fibers, natural fibers and any mixtures thereof. The fibrous material strip includes first and second ends 34, 36 respectively. The strip 32 is identical to the strip 12 of the FIG. 1 embodiment except that it is not connected to a nonflammable insulating skirt. Accordingly, it should also be appreciated that the first end 34 of the strip 32 may include a projecting lug 38 while the second end 36 of the strip 32 may include an aperture/socket 40 sized and shaped to receive the lug 38. Thus, the strip 32 like the strip 12 may be connected end to end in order to form a ring. In the alternative, multiple strips 32 may be positively connected together end to end to form a strip 32 of substantially any desired length.

Figure 5:
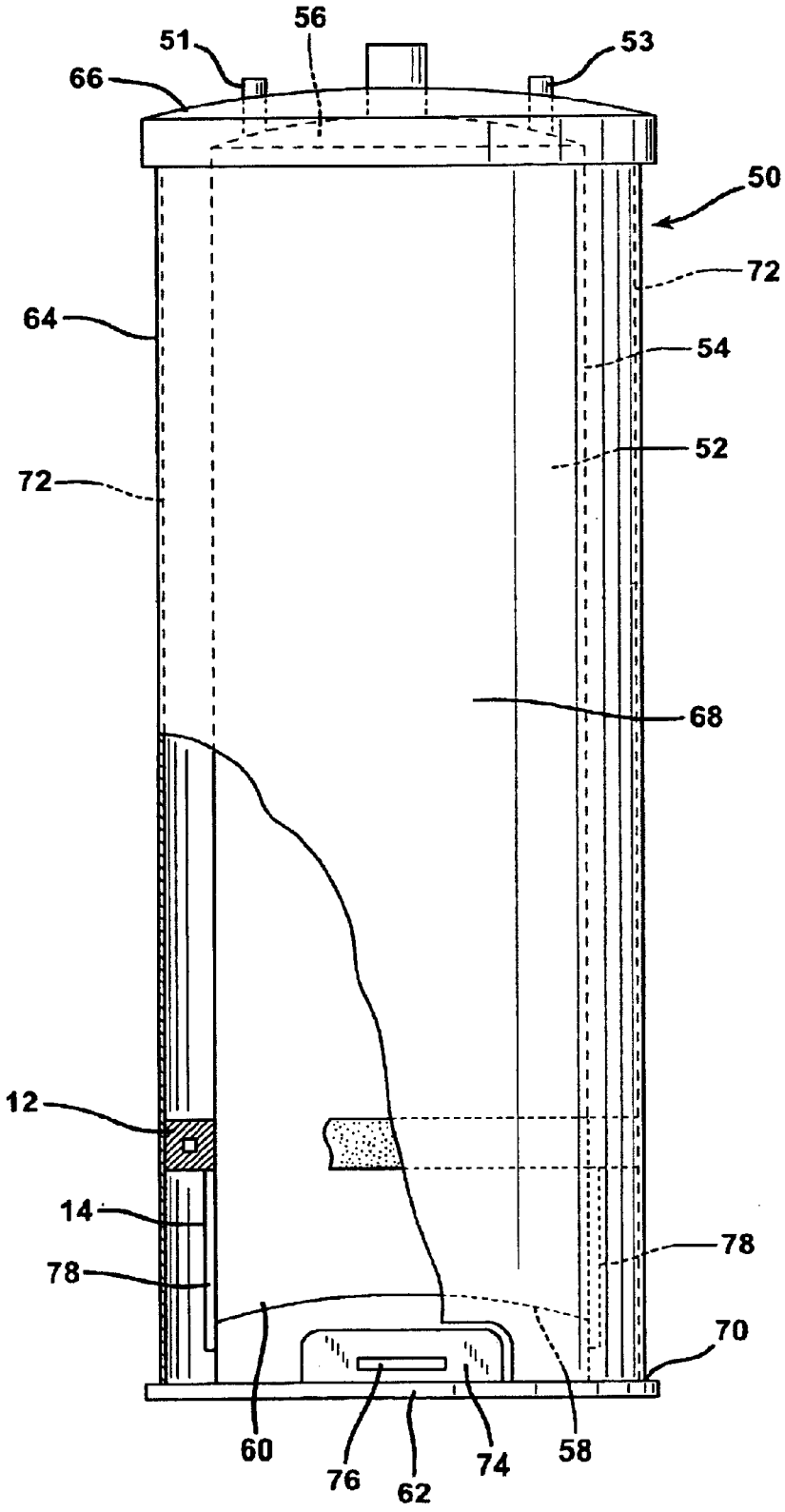
FIG. 5 is a schematical representation of a water heater in elevation with a partial cutaway section to show how the FIG. 1 embodiment of the present invention is applied and positioned in the water heater.

A hot water heater 50 incorporating the combined liquid foam stop and insulator 10 of the present invention is illustrated in FIG. 5. The hot water heater 50 includes a cylindrical inner tank 52 for holding hot water, a water inlet 51 and a water outlet 53. The inner tank 52 includes a sidewall 54, a top wall 56 and a bottom wall 58. The bottom wall 58 of the tank 52 rests upon a support ring 60 which in turn rests upon a support plate 62.

As also illustrated in FIG. 5, the hot water heater 50 includes an outer shell or jacket 64 having a top 66, a cylindrical sidewall 68 and a bottom edge 70. As illustrated, the jacket 64 is coaxial with and radially spaced from the tank 52, thereby forming an annular space or void 72 between the outer surface of the tank 52 and the inner surface of the jacket 64. As further illustrated, the bottom edge 70 of the jacket 64 rests upon the support plate 62.

The bottom edge 70 of the jacket 64 and the support ring 60 each include openings that register with each other to provide access to a heating chamber 74 located under the bottom 58 of the tank 52. A gas burner 76 is located within the heating chamber 74.

As further illustrated, the combined liquid foam stop and insulator 10 is wrapped around the outer surface of the sidewall 54 of the tank 52. More specifically, the fibrous material strip 12 is in the form of a sheet including a first side or top, a second side or bottom, a first or inner face, a second or outer face and first and second ends. The strip 12 is wrapped around the tank 52 at a height substantially above the heating chamber 74 while the nonflammable insulating skirt 14 extends downwardly along the sidewall 54 of the tank in an area near to or adjacent the heating chamber 74. Preferably, the strip 12 is of a length substantially corresponding to the circumference of the inner tank 52 so that the ends 24, 28 of the strip may be joined together and interlocked by inserting the projecting lug 22 on the first end in the socket 26 on the second end.

As should be appreciated, the strip 12 is compressed between the sidewall 54 of the tank 52 and the sidewall 68 of the jacket 64 as the jacket is positioned over the tank during the assembly process. As the result of the strip 12 being tightly wrapped around the tank 52, the strip tends to maintain its position relative to the tank as the jacket 64 slides over the tank until the bottom edge is in engagement with the support plate 62. Of course, if desired, the strip 12 could be adhered to the tank 52 with adhesive and/or positively held in position by means of a tool (not shown) from the bottom.

Once the jacket 64 is fully seated on the support plate 62 over the tank 52, a first section of the void 72 above the strip 12 may be filled with an expanded polymer foam insulating material for thermal insulation of the upper portion of the tank 52. Specifically, since the strip 12 is in sealing engagement with the sidewall 54 of the tank 52 and the sidewall 68 of the jacket 64, polymer foam is prevented from expanding into the lower or second section of the void 78 where the foam could come into contact with the heating chamber 74 and the flame of the gas burner 76. It should be appreciated, however, that the fibrous material strip 12 is sufficiently porous to allow gas to escape during the foaming process so that the void 72 does not become over pressurized. As noted above, the skirt 14 serves to insulate the tank 52 in the second section 78 of the void.

In summary, numerous benefits result from employing the concepts of the present invention. Unlike the polymer foam ring or dams of the prior art, the liquid foam stop of the present invention has an indefinite shelf-life thereby avoiding many potential inventory control problems. Further, the stop does not require the use of a slip agent during installation. Additionally, the stop may be more easily secured on the inner tank in the desired position so as to ensure that the flammable polyurethane foam insulation between the tank and the jacket is maintained a safe distance from the heating chamber and gas burner. Further, the combined liquid foam stop and insulator of the present invention ensures that the tank is continuously insulated over its entire length, by polymer foam above the strip, the strip and the nonflammable skirt below the strip in the vicinity of the heating chamber.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims and their fair and broad interpretation in any way.

What is claimed is:

1. A combined liquid foam stop and insulator for a tank assembly, comprising:

a fibrous material strip made from a material selected from a group consisting of polyester, polyethylene, polypropylene, polyethylene terephthalate, glass fibers, natural fibers and any mixture thereof; and a nonflammable insulating skirt connected to said fibrous material strip;

said combined liquid foam stop and insulator being characterized by having a first end, a second end, a projecting lug on said first end and a lug socket on said second end.

2. The combined liquid foam stop and insulator of claim 1, wherein said nonflammable insulating skirt is made from fiberglass.

3. The combined liquid foam stop and insulator of claim 2, wherein said fibrous material strip has a first thickness $T_1$ and said nonflammable insulating skirt is a second thickness $T_2$ where $T_1>T_2$.

4. The combined liquid foam stop and insulator of claim 3, wherein said thickness $T_1$ is about 2.52 to about 5.04 cm and said thickness $T_2$ is about 1.26 to about 2.52 cm.

5. The combined liquid foam stop and insulator of claim 4, further including an adhesive for securing said fibrous material strip to said nonflammable insulating skirt.

6. The combined liquid foam stop and insulator of claim 5, wherein said fibrous material strip has a density of about 1.5 to about 4.5 kg/m$^3$.

7. The combined liquid foam stop and insulator of claim 1, wherein said nonflammable insulating skirt is made from fiberglass.

8. The combined liquid foam stop and insulator of claim 1, wherein said fibrous material strip has a first thickness $T_1$ and said nonflammable insulating skirt has a second thickness $T_2$ where $T_1>T_2$.

9. The combined liquid foam stop and insulator of claim 8, wherein said thickness $T_1$ is about 2.52 to about 5.04 cm and said thickness $T_2$ is about 1.26 to about 2.52 cm.

10. The combined liquid foam stop and insulator of claim 1, further including an adhesive for securing said fibrous material strip with said nonflammable insulating skirt.

11. The combined liquid foam stop and insulator of claim 1, wherein said fibrous material strip has a density of about 1.5 to about 4.5 kg/m$^3$.

12. A liquid foam stop for a tank assembly, comprising:

a fibrous material strip made from a material selected from a group consisting of polyester, polyethylene, polypropylene, polyethylene terephthalate, glass fibers, natural fibers and any mixture thereof, said fibrous material strip including a first end and a second end, a projecting lug on said first end and a lug socket on said second end.

13. A water heater, comprising:

an inner tank including a water inlet and a water outlet;

an outer jacket received around said inner tank, said inner tank and outer jacket forming a void therebetween;

a heating chamber adjacent said inner tank; and a liquid foam stop made from a fibrous strip of material selected from a group consisting of polyester, polyethylene, polypropylene, polyethylene terephthalate, glass fibers, natural fibers and any mixtures thereof, said liquid foam stop sealing against said inner tank and said outer jacket so as to divide said void into a first section remote from said heating chamber and a second section adjacent said heating chamber, said liquid foam stop including a first end, a second end, a projecting lug on said first end and a lug socket on said second end.

14. The water heater of claim 13, wherein said first section of said void holds a polymer foam insulating material.

15. The water heater of claim 14, wherein said second section of said void holds a nonflammable insulating material.

16. The water heater of claim 13, wherein said liquid foam stop further includes a nonflammable insulating skirt.

17. The water heater of claim 16, wherein said first section of said void holds a polymer foam insulating material.

18. The water heater of claim 17, wherein said nonflammable insulating skirt insulates said second section of said void.

19. A combined liquid foam stop and insulator for a tank assembly, comprising:

a fibrous material strip made from a material selected from a group consisting of polyester, polyethylene, polypropylene, polyethylene terephthalate, natural fibers and any mixture thereof; and a nonflammable insulating skirt connected to said fibrous material strip.

* * * * *